US005245989A

United States Patent [19]

Simon

[11] Patent Number: 5,245,989

[45] Date of Patent: Sep. 21, 1993

[54] APPARATUS FOR PAIN RELIEF BY CONTROLLED CRANIAL PRESSURE

[76] Inventor: Rosalie Simon, 6548 Windemere Cir., Rockville, Md. 20852

[21] Appl. No.: 848,803

[22] Filed: Mar. 10, 1992

[51] Int. Cl.[5] ..... A61H 7/00; A61H 23/00

[52] U.S. Cl. ..... 128/52; 128/55

[58] Field of Search ..... 128/32, 34–40, 128/41–44, 51–55, 59–62 R

[56] References Cited

U.S. PATENT DOCUMENTS

| | | | |
|---|---|---|---|
| 849,844 | 4/1907 | Laurence | 128/56 X |
| 3,763,853 | 10/1973 | Jochimski | 128/36 |
| 3,955,563 | 5/1976 | Maione | 128/55 X |
| 4,412,535 | 11/1983 | Teren | 128/57 |
| 4,729,368 | 3/1988 | Guitay | 128/57 |
| 4,779,615 | 10/1988 | Frazier | 128/54 X |
| 4,920,466 | 4/1990 | Liu | 128/36 X |
| 5,083,552 | 1/1992 | Lipowitz | 128/44 |
| 5,088,474 | 2/1992 | Mabuchi et al. | 128/52 |

OTHER PUBLICATIONS

W. Grady, Stumbo, M.D., Acupressure: A Hands-On Technique For Treating Headaches, Feb., 1986.

*Primary Examiner*—Robert A. Hafer
*Assistant Examiner*—Brian E. Hanlon
*Attorney, Agent, or Firm*—Pennie & Edmonds

[57] ABSTRACT

A plurality of individually controlled pressure applying devices with a scalp contacting member, which are controlled by a computer, is attached to a helmet or a cap-like unit, each over an opening formed at locations which would correspond to the desired pressure points of the scalp. Each of the openings receives a pressure applying device, such as an electrical servo motor, step-motor, or solenoid, and a hydraulic or pneumatic plunger, etc. The pressure applying device may be non-adjustably or adjustably mounted to the helmet. The pressure applying device can be attached to the helmet in any conventional manner so long as the pressure applying device is rigidly attached to the helmet so that the scalp contacting member can make a firm contact and apply pressure to the scalp. Each of the pressure applying devices is individually controlled, i.e., for time duration and the frequency of pressure application.

12 Claims, 8 Drawing Sheets

APPARATUS FOR PAIN RELIEF BY CONTROLLED CRANIAL PRESSURE

BACKGROUND OF THE INVENTION

1. Field of the Invention

This invention relates to a device for applying controlled pressures to the predetermined locations of the human scalp to relieve pain such as headaches and migraine headaches.

2. Description of the Prior Art

It is widely known that headaches frequently attack humans. An article entitled "Acupressure: A Hands-on Technique for Treating Headaches" by W. Grady Stumbo, M.D., Journal of the Kentucky Medical Association, Feb. 1986 describes a hands-on technique for relieving headaches by using a thumb to exert pressure on the nerve points. Manual manipulation requires some degree of expertise to successfully apply pressure to the nerve points. Specifically, the person applying the pressure must be familiar with nerve points and their location and must apply the right amount of pressure for a prescribed duration, which is not all that easy to subscribe.

U.S. Pat. Nos. 4,469,092 to Marshall et al (hereafter Marshall), 3,763,853 to Jochimski (hereafter Jochimski), and 2,575,066 to Mierzejewski et al (hereafter Mierzejewski) describe devices for stimulating the human scalp. Specifically, in Marshall a cap or helmet like device has a large number of small finger-like protrusions which extend toward the interior of the helmet and make contact with the scalp when the helmet is placed over the head. In Mierzejewski, a relatively smaller number of larger finger-like projections extend toward the interior of the helmet, which make contact with the scalp when the helmet is placed over the head. In both Marshall and Mierzejewski, the projections are fixed relative to each other and are fixed in length so that each projection cannot be independently moved or controlled. To stimulate the scalp, the projections are attached to a device capable of producing vibratory motions such as a motor to simultaneously vibrate the entire projections. As a result, any massaging action to the scalp is a result of vibration of the entire unit rather than the individual projections.

The Jochimski patent, the disclosure of which is incorporated herein by reference, discloses a head vibrator unit which includes an oversized bowl shaped curvilinear helmet adapted for placing over a human head. Disposed on the helmet is a network of vibration transmitting members which includes a plurality of substantially rigid connecting rods, including an outer curvilinear rod, a pair of inner meridian connecting rods, a pair of outer connecting meridian rods, a rear curvilinear connecting rod, and side connecting rods. The paired meridian rods allow improved mounting of a portable vibrator and spans the paired rods. The vibrator includes a side-to-side eccentric weight and a front-to-back eccentric weight. These weights allow vibration along two axes which are perpendicular to each other.

The network of connecting rods are joined to a plurality of finger massaging assemblies. The network of rods transmits vibration to all the massaging fingers connected thereto using only a single vibrator.

Jochimski's head vibrator, like those of Marshall and Mierzejewski, uses a single motor to simultaneously vibrate the entire massaging fingers. As a result, any massaging action to the scalp is a result of vibration of the entire unit rather than the individual massaging fingers. No means have been contemplated nor is it feasible in Jochimski to individually control the vibrating action of the individual massaging fingers. Moreover, while Jochimski's head vibrator may relieve some cranial tension or headache, a mere vibratory massaging is not deemed to be effective for relieving more serious headaches such as migraine. Vibration to the scalp may actually cause a more severe headache due to vibration.

As indicated in the Acupressure article cited above, using pressure, with good results, can relieve headaches, including migraine headaches. Rather than manually applying pressure to nerve points, as described in the Acupressure article, the present invention uses an electro-mechanical device to discretely apply pressure to selected areas of the scalp, at a selected interval for a selected duration.

SUMMARY OF THE INVENTION

To carry out the above-described electro-mechanical device, the present invention contemplates a plurality of individually controlled pressure activating devices which are controlled by a computer. Specifically, as shown in the disclosure of Jochimski, which is incorporated herein by reference, a helmet or a cap like device has a plurality of openings formed at locations which would correspond to the desired pressure points of the scalp. Each of the openings receives a pressure applying device, such as an electrical servo motor, stepmotor or solenoid, or a hydraulic or pneumatic plunger, etc. The pressure applying devices may be non-adjustably or adjustably mounted to the helmet. For instance, the pressure applying device may be non-adjustably attached to the helmet by screwing into a threaded opening in the helmet or fixing it in any conventional manner. The pressure applying device may be adjustably attached to the helmet by forming a relatively large opening in the helmet and attaching a plate over the opening with the pressure applying device fixed to the plate. The pressure applying devices can be attached to the helmet in any conventional manner so long as the pressure applying device is rigidly attached to the helmet and make contact and apply pressure to the scalp.

The present invention is vastly different from Jochimski in several different ways. First, the present invention does away with the complex network of rigid vibration transmitting rods contemplated in Jochimski. Second, in the present invention, each of the massaging fingers is individually controlled, i.e., for time duration, frequency of pressure application, and the pressure application rather than vibrating the entire massaging fingers simultaneously.

Figure 5:
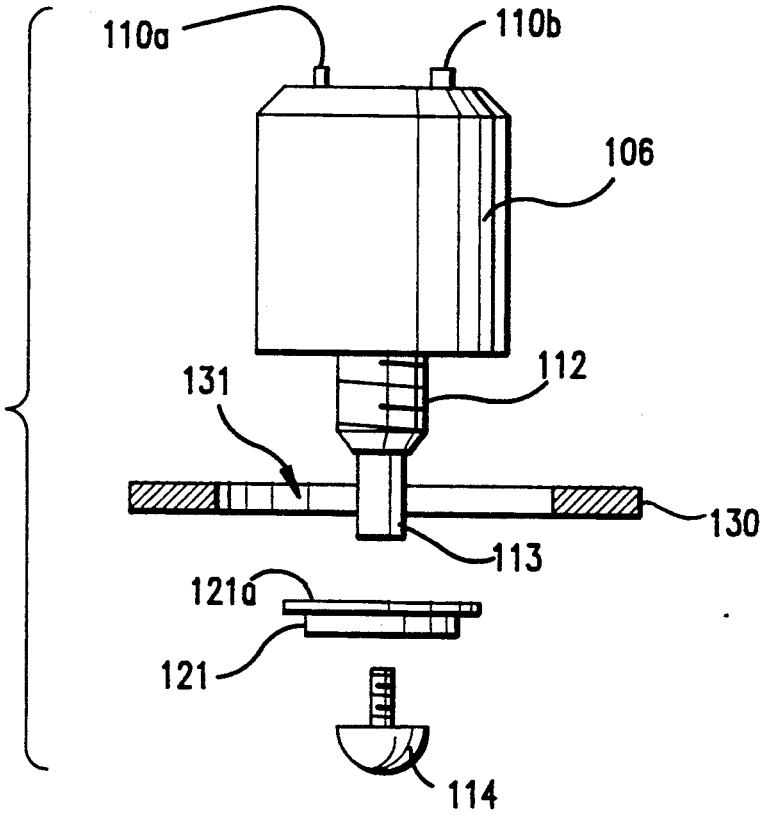
FIG. 5 is a side elevational view showing yet another alternative manner in which the pressure applying device can be attached to the helmet, taken along line 5—5 of FIG. 6, with the pressure applying device added for illustration.
Figure 6:
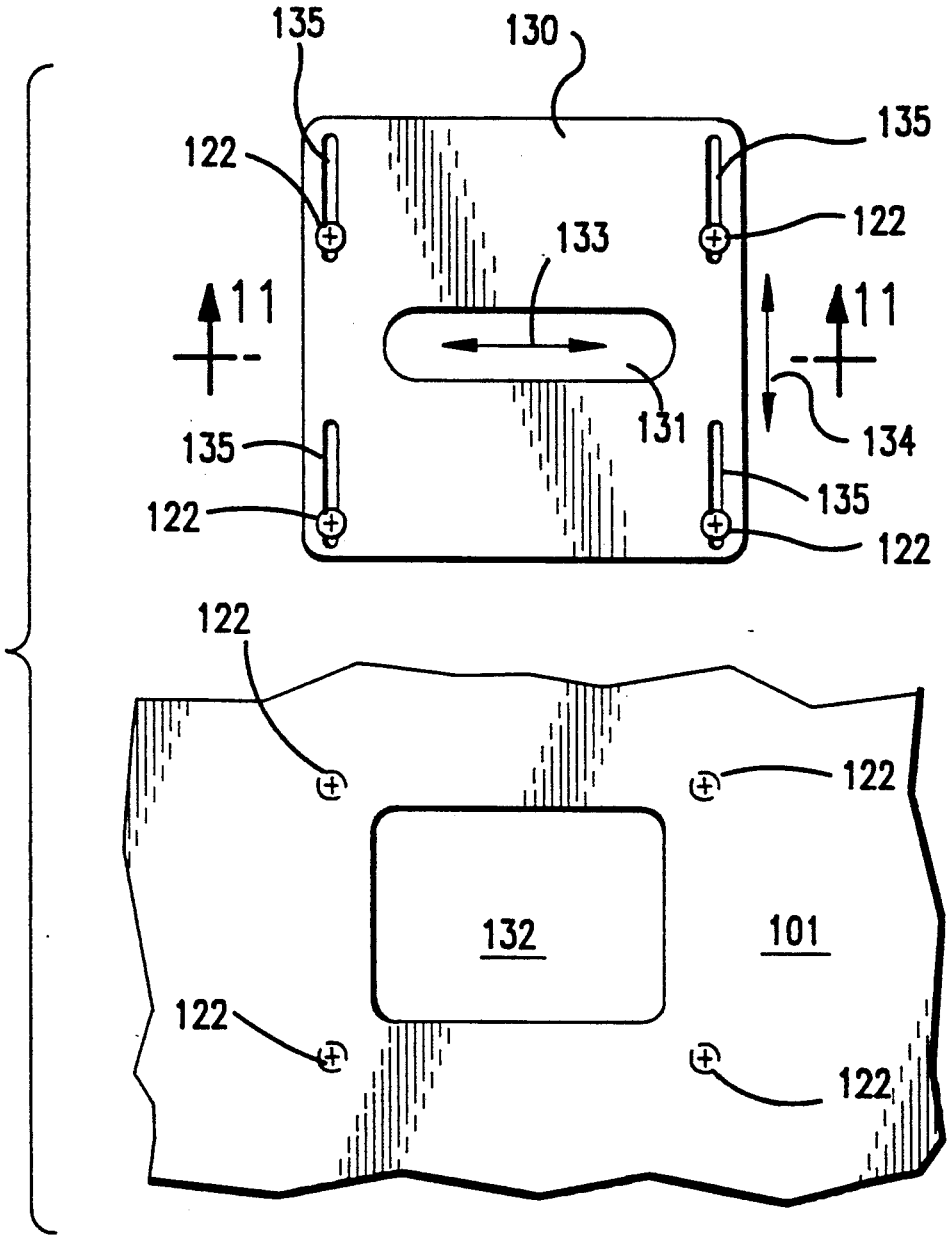

FIG. 6 is a plan view of the plate and the opening formed in the helmet for the embodiment of FIG. 5.

Figure 7:
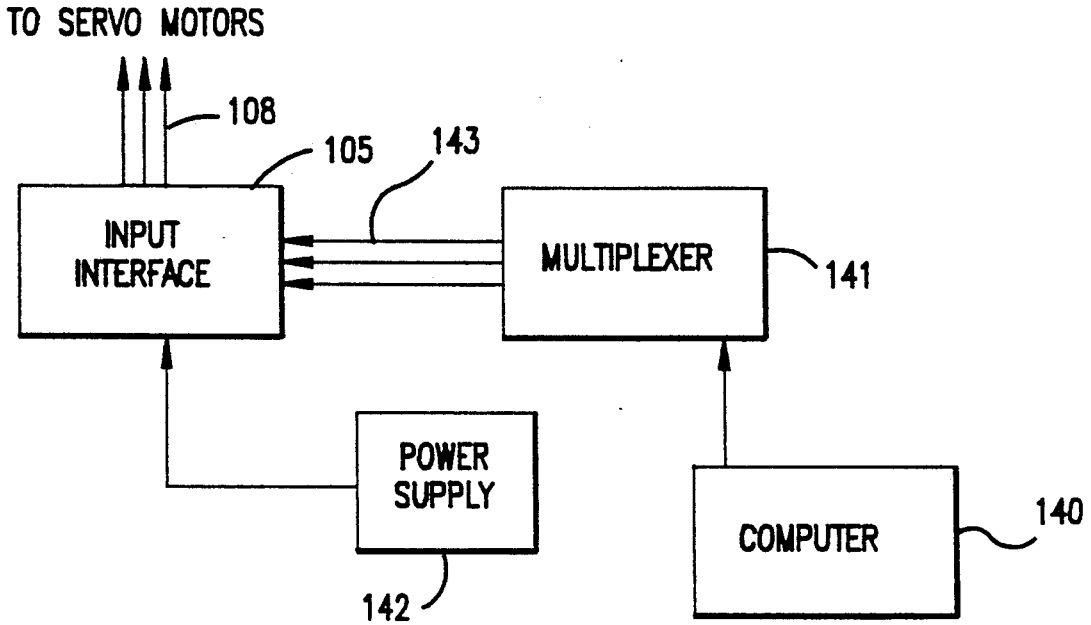

FIG. 7 shows a control system for operating the electrically operated pressure applying devices.

Figure 8:
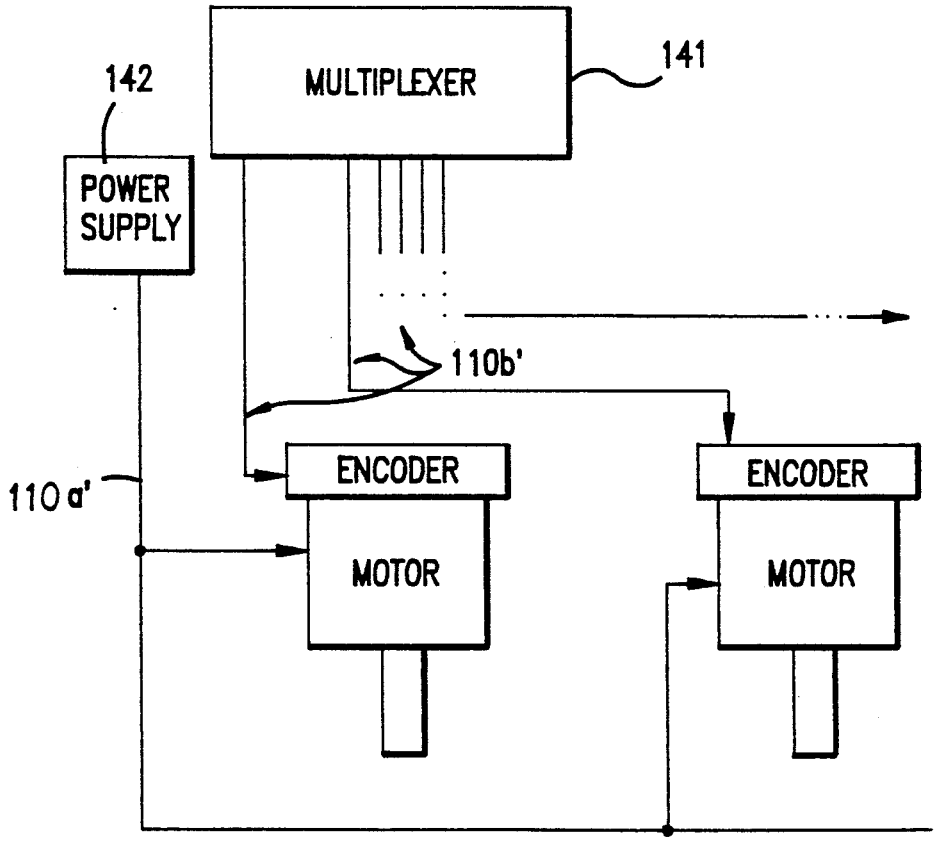

FIG. 8 shows a schematic diagram of the electrical connection between the multiplexer, the power supply, and the servo motors shown in FIG. 8.

Figure 9:
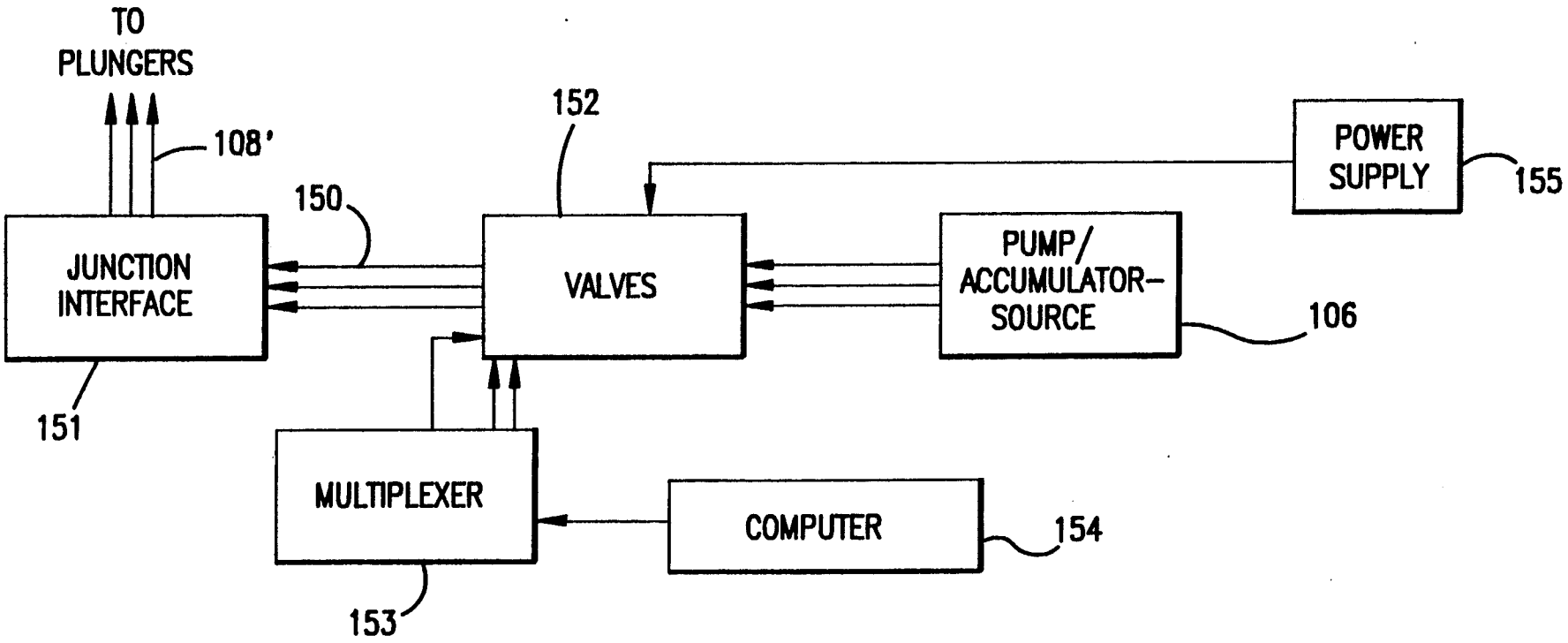

FIG. 9 shows a control system for operating the hydraulic or pneumatic pressure applying devices.

Figure 10B:
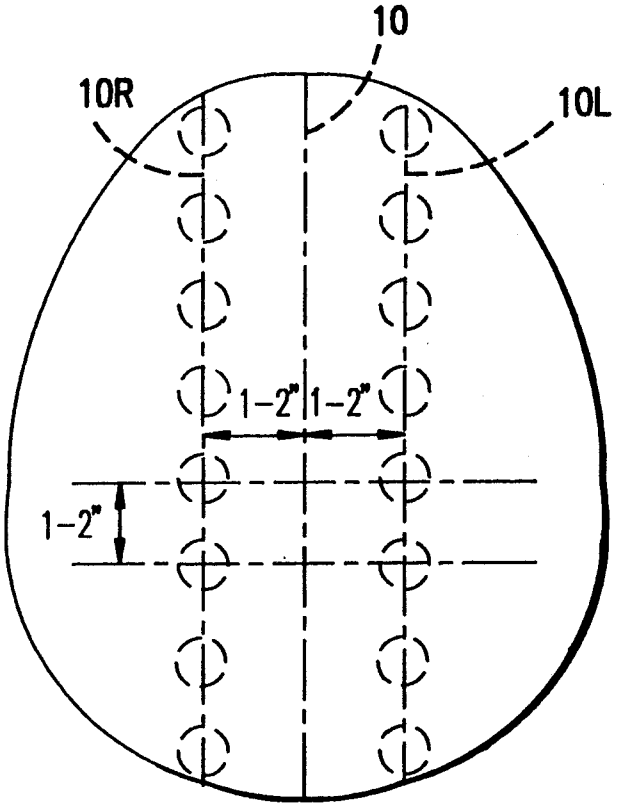
Figure 10A:
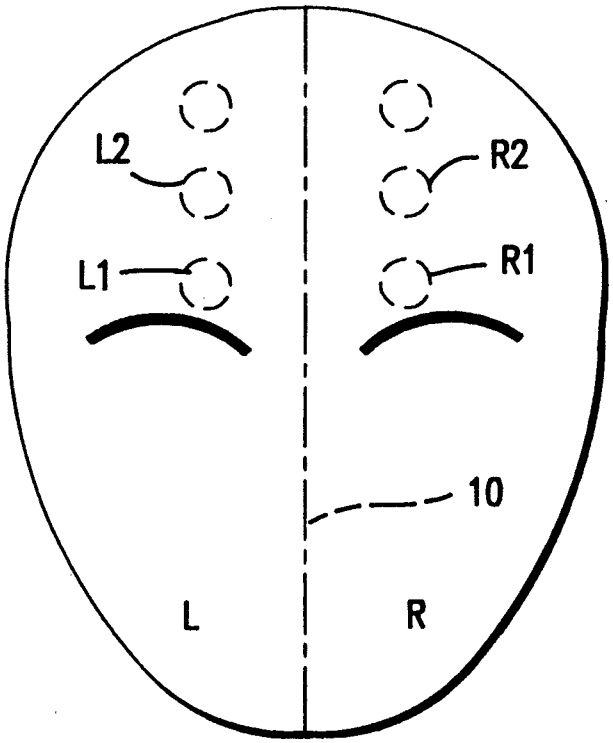
Figure 10C:
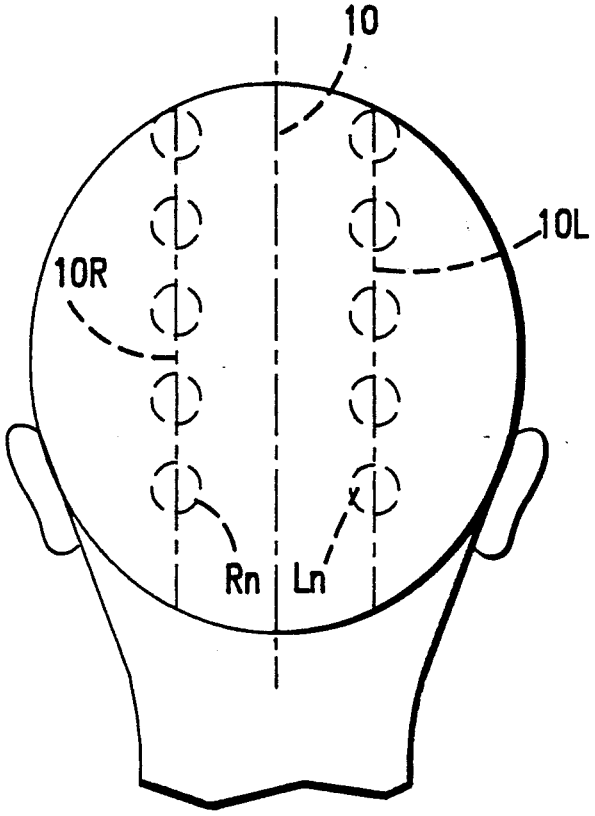

FIGS. 10*a*, 10*b* and 10*c* show a graphical representation of frontal, top and rear views, respectively, of a human head with an example of a pattern of the areas to be applied with pressure.

DESCRIPTION OF THE PREFERRED EMBODIMENT

Figure 1:
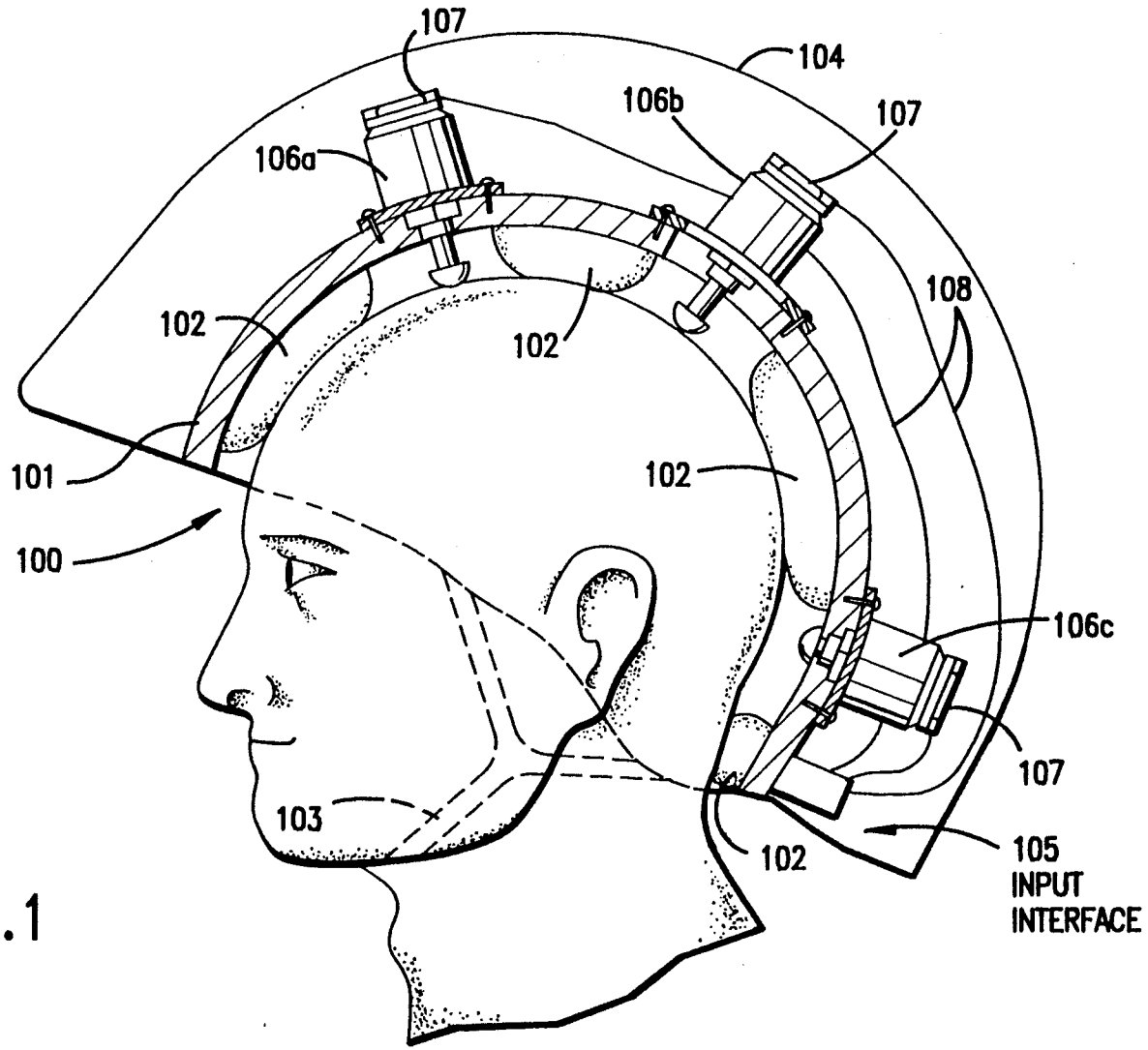
FIG. 1 is a partial cross-sectional side elevational view of the present invention which uses electrically operated pressure operating devices.

FIG. 1 shows a side view of the present invention 100 which is fitted over a person's head. FIG. 1 is shown with only three pressure applying devices 106*a*, 106*b*, and 106*c*, for simplicity sakes, but it is to be understood that many more pressure applying devices will be attached to the outer shell 101 of the helmet, as will be explained further below in detail. The devices 106*a* and 106*c* shown in FIG. 1 is fixedly attached to the outer shell using a plate and four screws as shown in details in FIGS. 3 and 4. The device 106*b*, on the other hand, for exemplary purposes, is attached to the outer shell using an adjustable plate as shown in details in FIGS. 5 and 6. It is to be noted that while the pressure applying devices are shown as electrically operated servo motor, solenoid, or stepmotor, a pneumatic or hydraulically operated plunger can equally be contemplated. The size and shape of hydraulically or pneumatically operated pressure application devices can be similar to the electrically operated pressure actuating devices. With respect to the embodiment shown in FIG. 1, the only change required in the helmet to use pneumatic or hydraulic devices is that the electrically operated pressure applying device will be substituted with the pneumatically or hydraulically operated pressure applying devices. Electrical wiring will be substituted with hydraulic or pneumatic lines. The pneumatic or hydraulic devices can be attached to the outer shell 101 in the same manner as shown in FIGS. 1, 2, 3, and 11.

Figure 2:
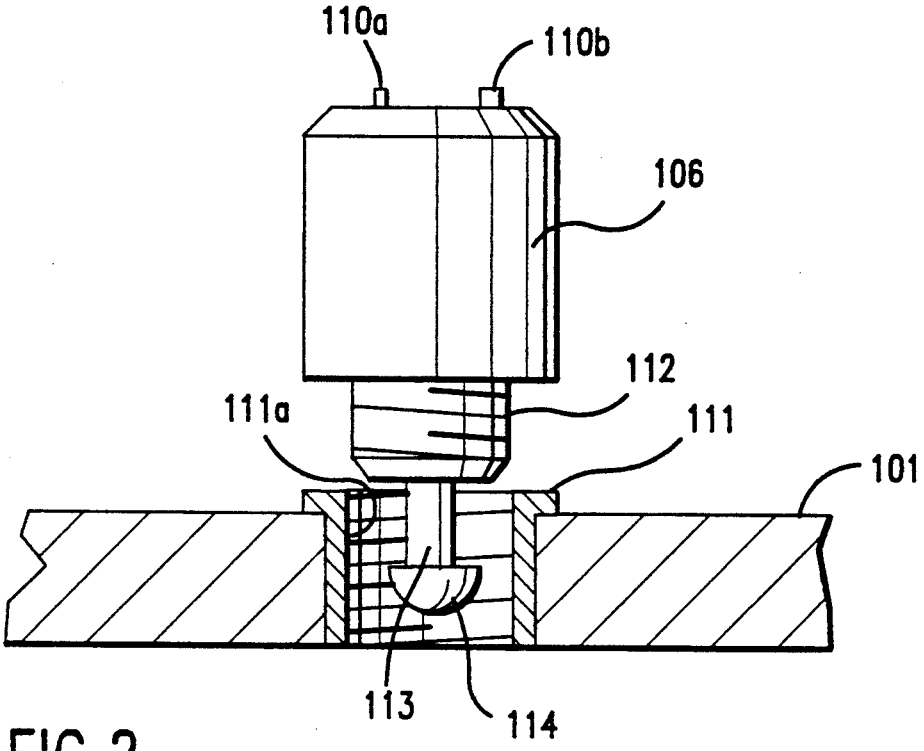
FIG. 2 is a side elevational view showing the manner in which the electrically operated pressure applying device can be attached to the helmet.

Further, while FIG. 1 is shown with the pressure applying device being attached using plates, they can be just as easily attached by screwing the pressure applying device into a threaded opening formed in the outer shell, for example, as shown in FIG. 2.

The hemet may assume a construction and shape similar to a motorcycle helmet or a football helmet with openings formed therein at specified locations for mounting the pressure applying devices. The helmet may be manufactured by injecting molding, and it can be multiple piece construction comprising individual die-cut plastic strips which are then fused together. The inner liner 102 may take a form of a plurality of detachable foam cushions which can be attached/detached with velcro, as is conventionally used, for instance, in a bicycle helmet. The helmet may also be a modified motorcycle helmet or a motorcycle helmet. One skilled in the art could contemplate using any helmet like devices, including the latest Army issue helmet, for example.

The helmet shown in FIG. 1 has a plurality of foam cushions or inflatable bags 102 supported inside the outer shell 101 so as to snugly form fit over the head. The foam cushions can be attached and detached using velcro so that foam cushions of various thickness can be used to snugly size over a person's head. Straps 103 are attached to the helmet in a conventional manner, strapping under the person's chin to firmly hold the helmet over the person's head during pressure application. A cover 104 is to be placed over the helmet to protect the pressure applying devices and their electrical connections or pneumatic or hydraulic lines.

Figure 3:
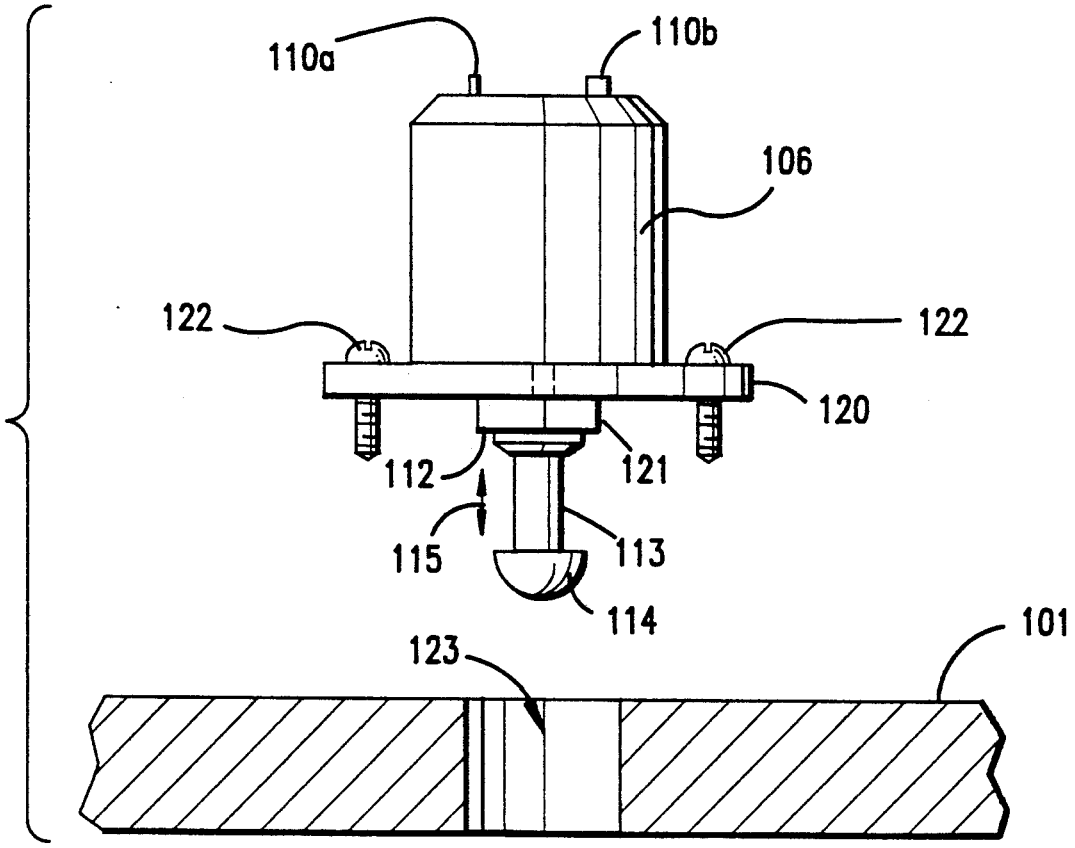
FIG. 3 is a side elevational view showing an alternative manner in which the pressure applying device can be attached to the helmet.

The wires 108 for supplying power and control signals to the pressure applying devices are to be neatly connected to the input interface 105. In the case of hydraulic or pneumatic pressure applying devices, a junction interface can be used in the similar manner to neatly connect all the pneumatic or hydraulic lines. Connectors 107 may be used to detachably connect the wires to the pressure applying devices' terminals 110 as shown in FIGS. 2, 3, and 5. In the case of pneumatic or hydraulic lines, conventional detachable pneumatic or hydraulic connectors may be used.

FIG. 2 shows one embodiment in which the pressure applying device is attached to the outer shell 101 of the helmet via an opening formed with threads. This can be accomplished in one of several ways. First, an anchor 111 with an inner threading 111*a* and ribbed outer surface can be press fitted into an opening formed in the helmet. The pressure applying device has threads 112 which conform to the inner threading so that the pressure applying device can be fixedly secured. Secondly, depending on the outer shell material, the outer shell can be tapped and the pressure applying device can be directly screwed into the outer shell. Alternatively, the threading 112 can be a self-threading type, in which it can be directly screwed into the opening formed in the outer shell.

The shaft 113 moves up and down (as shown by arrows 115 in FIG. 3) upon actuation of the pressure applying device so that it can supply pressure to the scalp. Specifically, by supplying control signals to the terminals, the shaft can be made to move inside toward the body of the pressure applying device or move out away from the body.

As shown in FIG. 5, the pressure applying member 114 is threaded into a threaded opening formed in the shaft 113. By using various sized members 114 having varying shapes and contact areas, depth penetration and pressure can be controlled. The member 114 is resilient, but firm, and can be made of rubber, nylon, plastics, etc.

FIG. 3 shows the embodiment by which the pressure applying devices 106*a* and 106*c* are mounted to the outer shell 101. In this embodiment, the mounting assembly is a circular plate 120 with a central opening large enough to fit the threading 112 therethrough. A nut 121 is placed over the threading and tightened to securely hold the plate against the pressure applying device. Then, the pressure applying member 114 is threaded into a threaded opening in the shaft 113.

Figure 4:
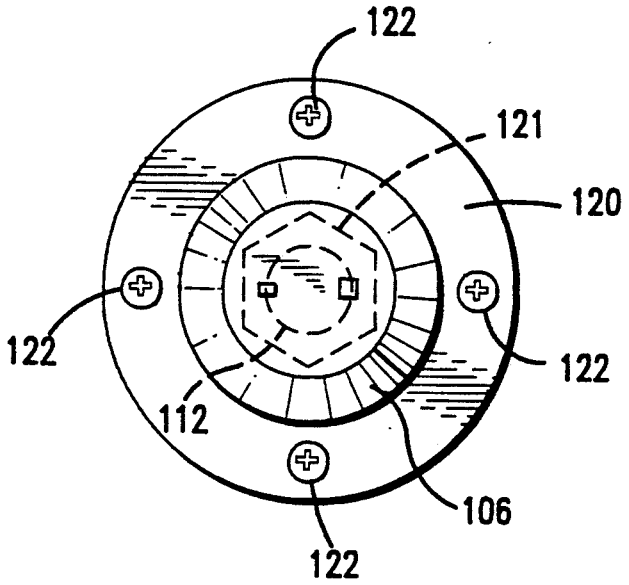
FIG. 4 is a plan view of FIG. 3.

As better shown in FIG. 4, the circular plate has four openings for screws. Preferably, a minimum of three screws can be used instead if desired. The pressure applying device with the mounting assembly is positioned over the opening 123 formed in the outer shell 101 and securely held thereto with the screws positioned into the outer shell.

FIGS. 5 and 6 show another embodiment by which the pressure applying device 106*b* is mounted to the outer shell 101. In this mounting arrangement, the applying device is adjustably mounted so that it can be accurately placed over a desired point. As shown in FIG. 6, the mounting assembly comprises a square plate 130 formed with an elongated opening 131 by which the threading 112 can be moved laterally thereabout as shown by the arrows 133. Once the proper lateral position is achieved, the pressure applying device can be locked relative to the plate 130 using a threaded nut 121 with a built in washer 121*a* or a separate washer. The plate also has 4 parallel elongated openings 135 in which the plate can be positioned laterally (as shown by arrows 134) about the fixed positions of the screws 122 shown in both solid and phantom. The opening 132 formed in the outer shell 101 must be as large as possible to permit maximum adjustability.

FIG. 7 shows a schematic diagram for controlling the electrical pressure applying devices 106. Each pressure applying device 106 includes a servo motor assembly which has a rotary stepper motor, rotary-to-linear lead screw, and encoder interface. A computer 140, preferably a widely available PC, with an appropriate conventional output interface can be used to send control signals (pulses) to the step motors which is converted to a linear motion by the lead screw. The servo motor assemblies are conventional. MICRO MO ELECTRONICS INC. makes MICRO MO type 1624T Model 003S light-duty stepper, with 16A reduction gear head and HE encoder which can be used with BERG CORPORATION rotary-to-linear lead screw, for example. The computer is interfaced to a multiplexer 141 to distribute control signals to individual servo motors. Control signals from the multiplexer are connected via control signal cables 143 to the input interface 105 built into the helmet, which in turn are sent to the servo motors via the connection wires 108. A power supply 142 is connected to all of the servo motors via the input interface. A touch screen may be utilized to input desired patterns of pressure application, using a software program to control the same. It is believed one skilled in programming art can easily provide the necessary program to operate and independently control each pressure applying device as desired.

FIG. 8 shows in detail the electrical connections between the multiplexer, the power supply and the servo motor. The power supply is distributed to all of the servo motors via wires 110*a*' to a terminal 110*a*. Control signals are sent to the encoder via a terminal 110*b* via wires 110*b*'.

FIG. 9 shows a schematic diagram for controlling hydraulic or pneumatic pressure applying devices, for instance, a plunger. The pneumatic or hydraulic connection lines 150 are connected to the junction interface 151 built into the helmet. Electrically controlled valves 152, which are connected to a pump/accumulator-source 156, are controlled by a computer 154 using a multiplexer 153 to individually control the valves. A power supply 155 is connected to the valves to supply power to the actuators associated with the valves. Using the multiplexer, valves are individually and independently controlled to control each of the plungers in response to the control signals provided from the computer.

FIGS. 10*a*, 10*b* and 10*c* depict a graphical representation of a human head with graphical representation of the areas to be applied with pressure shown in phantom lines. This is merely one example of the pattern of the pressure areas which can be contemplated for use with the present invention. The pressure applying devices 106 are to be positioned in the helmet so that they apply pressure to these pressure areas.

FIG. 10*a* shows a front view of the head 1, namely the face 1*a*. Dotted line 10 is a central circumferential line of the head which divides equally a left hemisphere L and right hemisphere R of the head. The first set of pressure areas are shown as L1 and R1. These areas are found immediately above the eyebrow and between 1 and 2 inch on either side of the line 10.

FIG. 10*c* shows the back of the head. The last pressure areas Ln and Rn are found about the earlobe level. Depending on the size of the head and the spacing between the adjacent pressure areas, the number of the pressure areas will inevitably vary.

As shown in FIG. 10*b*, the line 10L intersecting the central areas of L1–Ln and the line 10R intersecting the central areas of R1–Rn run generally parallel to the line 10. The distance between the adjacent two left pressure areas is between 1 to 2 inches. Likewise, the distance between the adjacent two right pressure areas is between 1 and 2 inches as well.

The helmet can have a pair of parallel slots (not shown) running parallel to either side of the line 10 and distanced between 1 to 2 inches therefrom. Any feasible number of pressure applying devices 106 can then be adjustably anchored about anywhere along the slots spaced between 1 and 2 inches.

In operation, a computer can be programmed to operate the pressure applying devices to apply pressure to the pressure areas in any of the following sequences:

A. Simultaneously apply pressure for a predetermined duration to L1,R1 through Ln,Rn for a predetermined number of times (simultaneously operating all the pressure applying devices);

B. Apply pressure only once to L1,R1 for a predetermined duration, thereafter to L2,R2, ... to Ln,Rn and repeat the sequence for a predetermined time or number of times;

C. Apply pressure to L1,R1 for a predetermined duration and number of times, thereafter to L2,R2, ... to Ln,Rn and repeat the sequence for a predetermined time or number of times;

D. Apply pressure only once to L1 for a predetermined duration then to R1 once for a predetermined duration, thereafter to L2 and then R2 until Ln and Rn;

E. Random application; and

F. Manual control of each pressure applying device using push-buttons to actuate individual pressure applying devices.

It will be apparent to one skilled in the art that a computer could be programmed to operate the sequence of the pressure applying devices in any manner desired. It is to be contemplated that the predetermined period and number of times of pressure application is to be adjustable. Furthermore, instead of readily available PCs, a dedicated small handheld computer can be contemplated so that all of the control can be readily accessible.

The foregoing is merely illustrative of the principles of the present invention. Numerous modifications can be expediently made as will be recognized by those skilled in the art. Therefore, it is to be understood that the present invention is not to be limited to the exact construction illustrated and described. All expedient modifications within the scope of the present invention can readily be contemplated without departing from the scope and breadth of the present invention.

I claim:

1. An apparatus for applying controlled cranial pressure, comprising;

a substantially rigid cap or a helmet-like member for fitting over a person's head, said rigid cap or helmet-like member having a plurality of openings formed at predetermined locations; and a plurality of discrete pressure applying devices, each pressure applying device having a driving unit which is independently actuable and controllable independent of other pressure applying units, and attached to said rigid cap or helmet-like member over one of said openings, wherein each said pressure applying drive unit has a housing and a shaft having a scalp contacting member attached at its end, said shaft activated by said drive unit, wherein said shaft is coaxially situated within said housing and movable in a linear direction relative to said housing for applying pressure to the scalp.

2. An apparatus according o claim 1, wherein said pressure applying driving unit is an electrically controlled servo motor.

3. An apparatus according to claim 1, wherein said pressure applying driving unit is hydraulically or pneumatically controlled.

4. An apparatus according to claim 1, further comprising a control means for independently controlling the movement of individual shafts of said pressure applying units.

5. An apparatus according to claim 1, wherein some of said pressure applying driving units are adjustably mounted to said helmet-like member and some of said pressure applying driving units are non-adjustably mounted.

6. An apparatus according to claim 1, wherein said pressure applying driving units are adjustably mounted.

7. A system for applying controlled cranial pressure, comprising;

a substantially rigid cap or a helmet-like member for fitting over a person's head, said rigid cap or helmet-like member having a plurality of openings formed at predetermined locations; and a plurality of discrete pressure applying devices, each pressure applying device having a drive unit which is independently actuable and controllable independent of other pressure applying drive units, and attached to said rigid cap or helmet-like member over one of said openings, wherein each said pressure applying drive unit has a housing and a shaft having a scalp contacting said shaft activated by said drive unit, wherein said shaft is coaxially situated within said housing and movable in a linear direction relative to said housing for applying pressure to the scalp; and a control means for independently controlling the movement of individual shafts of said pressure applying drive units.

8. A system according to claim 7, wherein said pressure applying driving unit is an electrically controlled servo motor.

9. A system according to claim 7, wherein said pressure applying driving unit is hydraulically or pneumatically controlled.

10. A system according to claim 7, wherein said pressure applying driving units are adjustably mounted to said helmet-like member.

11. A system according to claim 7, wherein each of said pressure applying driving units are adjustably mounted.

12. A system according to claim 7, wherein said control means comprises a computer connected to a multiplexer means for individually controlling each of said plurality of pressure applying driving units.

* * * * *